US008226330B2

(12) United States Patent
Blouin

(10) Patent No.: US 8,226,330 B2
(45) Date of Patent: Jul. 24, 2012

(54) EARTH-REINFORCING REVETMENTS FOR LANDSCAPING AREAS AND METHODS OF USE AND MANUFACTURE THEREOF

(76) Inventor: Christopher W. Blouin, Langley (CA)

( * ) Notice: Subject to any disclaimer, the term of this patent is extended or adjusted under 35 U.S.C. 154(b) by 128 days.

(21) Appl. No.: 12/460,990

(22) Filed: Jul. 28, 2009

(65) Prior Publication Data

US 2011/0027016 A1 Feb. 3, 2011

(51) Int. Cl.
*E02D 17/20* (2006.01)

(52) U.S. Cl. ..... 405/302.4; 405/262; 405/284

(58) Field of Classification Search ..... 405/16, 405/17, 19, 262, 284, 302.4, 302.6, 302.7
See application file for complete search history.

(56) References Cited

U.S. PATENT DOCUMENTS 4,329,089 A * 5/1982 Hilfiker et al. ..... 405/262
5,722,799 A * 3/1998 Hilfiker ..... 405/262
5,733,072 A * 3/1998 Hilfiker et al. ..... 405/284
6,345,934 B1 * 2/2002 Jailloux et al. ..... 405/262
6,357,970 B1 * 3/2002 Hilfiker et al. ..... 405/302.7
6,595,726 B1 * 7/2003 Egan et al. ..... 405/284
7,033,118 B2 * 4/2006 Hilfiker ..... 405/262
7,281,882 B2 * 10/2007 Hilfiker et al. ..... 405/262
2006/0239783 A1 * 10/2006 Kallen ..... 405/284

* cited by examiner

*Primary Examiner* — David Bagnell
*Assistant Examiner* — Benjamin Fiorello
(74) *Attorney, Agent, or Firm* — John R. Flanagan

(57) ABSTRACT

A method for landscaping an area using an earth-reinforcing revetment includes the steps of providing a first structure of at least one landscaping apparatus having a measure of openings and a base region, providing a second structure of the at least one landscaping apparatus having a measure of openings greater than the measure of openings of the second structure, arranging the second structure at an angle relative to the first structure such that the angle defines a landscaping feature, arranging at least a portion of the first structure on a landscaping region of the area such that the landscaping region at least partially supports base region of the first structure, and disposing landscaping material on the first structure of the landscaping apparatus so as to define a feature for the area. Also, a landscaping apparatus of an earth-reinforcing revetment includes the above described structures.

5 Claims, 8 Drawing Sheets

EARTH-REINFORCING REVETMENTS FOR LANDSCAPING AREAS AND METHODS OF USE AND MANUFACTURE THEREOF

TECHNICAL FIELD

The field of invention generally relates to the art of revetments for protecting earthen banks from erosion and/or collapse or for creating new embankments and, more particularly, is concerned with earth-reinforcing revetments for landscaping areas and methods of use and manufacture thereof.

BACKGROUND

Earth-reinforcing revetments may be used to modify features of an area of land. In particular, earth-reinforcing revetments may buttress land material to define sloped features such as hills. Earth-reinforcing revetments typically include a base region that may be placed on the area of land to be modified and an elevated region positioned at an angle so as to maintain a shape of an artificial landscaping feature formed on the area. Further, the earth-reinforcing revetment may be designed such that erosion of the landscaping feature may be reduced over time.

To sufficiently retain earth or other land material in accord with the desired landscaping feature over time, a measure of openings in the earth-reinforcing revetment should be sufficiently low to reduce the flow of land material through it as desired to maintain the landscaping feature, which competes with the requirement to reduce material required to economically fabricate the earth-reinforcing revetment. As such, the cost of manufacture and performance of the revetment may be in competition.

There is an additional desire to provide increased rigidity of the elevated region compared to the base region, without incurring unnecessary material costs.

SUMMARY

A method is disclosed for landscaping an area using an earth-reinforcing revetment. The method comprises the steps of providing a first structure of at least one landscaping apparatus having a measure of openings extending therethrough and including a base region, providing a second structure of the at least one landscaping apparatus having a measure of openings extending therethrough wherein the measure of openings of the first structure is greater than the measure of openings of the second structure, arranging the second structure at an angle relative to the first structure such that the angle defines a landscaping feature, arranging at least a portion of the first structure on a landscaping region of the area such that the landscaping region at least partially supports the base region of the first structure, and disposing landscaping material on the first structure of the landscaping apparatus so as to define a feature for the area. Also included is a landscaping apparatus of an earth-reinforcing revetment comprising the structures described above.

DETAILED DESCRIPTION

The following detailed description includes references to the accompanying drawings, which form a part of the detailed description. The drawings show, by way of illustration, specific embodiments in which the apparatus and methods may be practiced. These embodiments, which are also referred to herein as "examples" or "options," are described in enough detail to enable those skilled in the art to practice the present invention. The embodiments may be combined, other embodiments may be utilized or structural or logical changes may be made without departing from the scope of the invention.

In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation.

Figure 1:
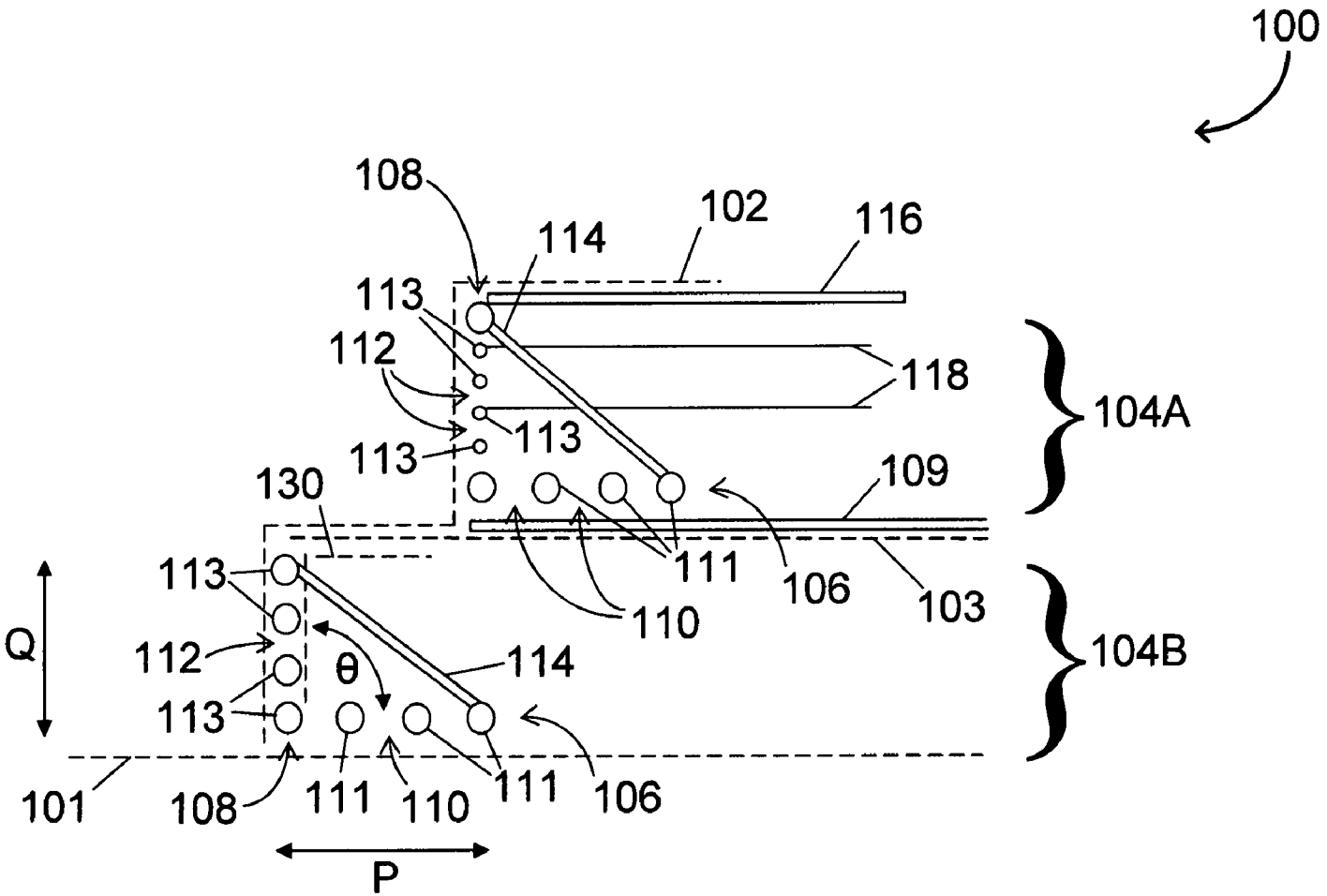
FIG. 1 is a schematic illustration of a view of an earth-reinforcing revetment, according to some embodiments.

FIG. 1 is a schematic illustration of an embodiment of an earth-reinforcing revetment, according to some embodiments, generally designated 100. Earth-reinforcing revetment 100 may be configured to reinforce a landscaping feature formed on a landscaping area, as shown at dashed line 101. Examples of landscaping features, as shown approximately in profile at dashed line 102, may include a hill, a slope, a stepped face, a vertical face or a near-vertical face. In addition, a single apparatus 104A of the earth-reinforcing revetment 100 may be configured to reinforce a landscaping feature formed on an intermediary landscaping area, as shown at dashed line 103, above another apparatus 104B.

As shown in FIG. 1, earth-reinforcing revetment 100 may include a plurality of landscaping apparatuses 104A, 104B, although the earth-reinforcing revetment 100 may include a single landscaping apparatus. If there are a plurality of such apparatuses, they may be the same or different. Each landscaping apparatus 104A, 104B may include a first structure 106 having a base region supported by the landscaping area 101 and a second structure 108 positioned at an angle relative to the first structure 106 and having an elevated region disposed adjacent to the landscaping area 101. The first structure 106 may define a plurality of openings 110 therethrough. Similarly, the second structure 108 may define a plurality of openings 112 therethrough. Thus, the first structure 106 may be associated with a measure of openings defined by the plurality of openings 110 in the first structure 106, and the second structure 108 may be associated with a measure of openings defined by the plurality of openings 112 in the second structure. Furthermore, the measure of openings 112 of the second structure 108 may be less than the measure of openings 110 in the first structure 106. As such, a penetrability of the second structure 108 may be less than the penetrability of the first structure 106.

In some embodiments, the first structure 106 may include a plurality of wires 111 defining the plurality of openings 110 between them extending through the first structure 106. Similarly, in some embodiments, the second structure 108 may include a plurality of wires 113 defining the plurality of openings 112 between them extending through the second structure 108. In one particular example, the measure of openings 110, 112 for the first and/or second structures 106, 108 may be inversely proportional to a number of wires 111, 113 per unit surface area (or length) of the structure, as shown in the lower apparatus 104B. In first structure 106 of apparatus 104B, there are p wires 111 per width P, and in second structure 108 of apparatus 104B there are q wires 113 per width Q. The measures of the openings 110, 112 are therefore approximately proportional to P/p and Q/q respectively. In another particular example the measure of openings 110, 112 for the first and/or second structures 106, 108 may be inversely proportional to a number of openings 110, 112 per unit length along the corresponding structure.

In another example, a plurality of wires 111 of the first structure 106 may have a diameter that may be more than a diameter of a plurality of wires 113 of the second structure 108, as shown in the upper apparatus 104A.

In doing this, earth may be substantially retained within the angle θ formed by the first and second structures 106, 108 while reducing the amount of material required to manufacture the first structure 106 thereby offering cost saving benefits for the manufacture of the earth-reinforcing revetment 100.

Furthermore, the earth-reinforcing revetment 100 may include a variety of additional structures for providing additional reinforcement. In some embodiments, the earth-reinforcing revetment 100 may include a support strut 114. Specifically, one or more support struts 114 may be coupled to the first structure 106 and the second structure 108 so as to maintain the angle θ between the first structure 106 and the second structure 108. In some embodiments, the earth-reinforcing revetment 100 may include a primary reinforcing structure 116. The primary reinforcing structure 116 may be subgrade and positioned as a top layer for the earth-reinforcing revetment 100. Alternately or in addition, a primary reinforcing structure 109 may be positioned between or attached to adjacent landscaping apparatuses 104A, 104B and/or may be positioned as a bottom layer for the earth-reinforcing revetment 100. Furthermore, the earth-reinforcing revetment 100 may include one or more secondary reinforcement structures 118 disposed between and substantially in parallel with the first structure 106 and the primary reinforcing structure 116. These secondary reinforcement structures 118 may continue and bend up or down in proximity to the inside of the front face, or second structure 108. There may alternately or optionally be separate secondary reinforcements (not shown) placed in proximity to the inside of the front face.

It may be understood that the primary and secondary reinforcing structures 109, 118 may include any suitable material, such as geogrids or geotextiles. Non-limiting examples of suitable material for these include polypropylene, polyester, or high-density polyethylene polymer. Other materials could include fibreglass reinforced material, steel and alloy grid/mesh/fabric, or copolymer composite reinforced fabric.

Referring still to FIG. 1, the earth-reinforcing revetment 100 may optionally include a turf reinforcement mat 130 adjacent to the second structure 108. Specifically, the turf reinforcement mat 130 may define a plurality of openings (not shown) such that the turf reinforcement mat 130 has a measure of openings less than the measure of openings 112 of the second structure 108.

Figure 2:
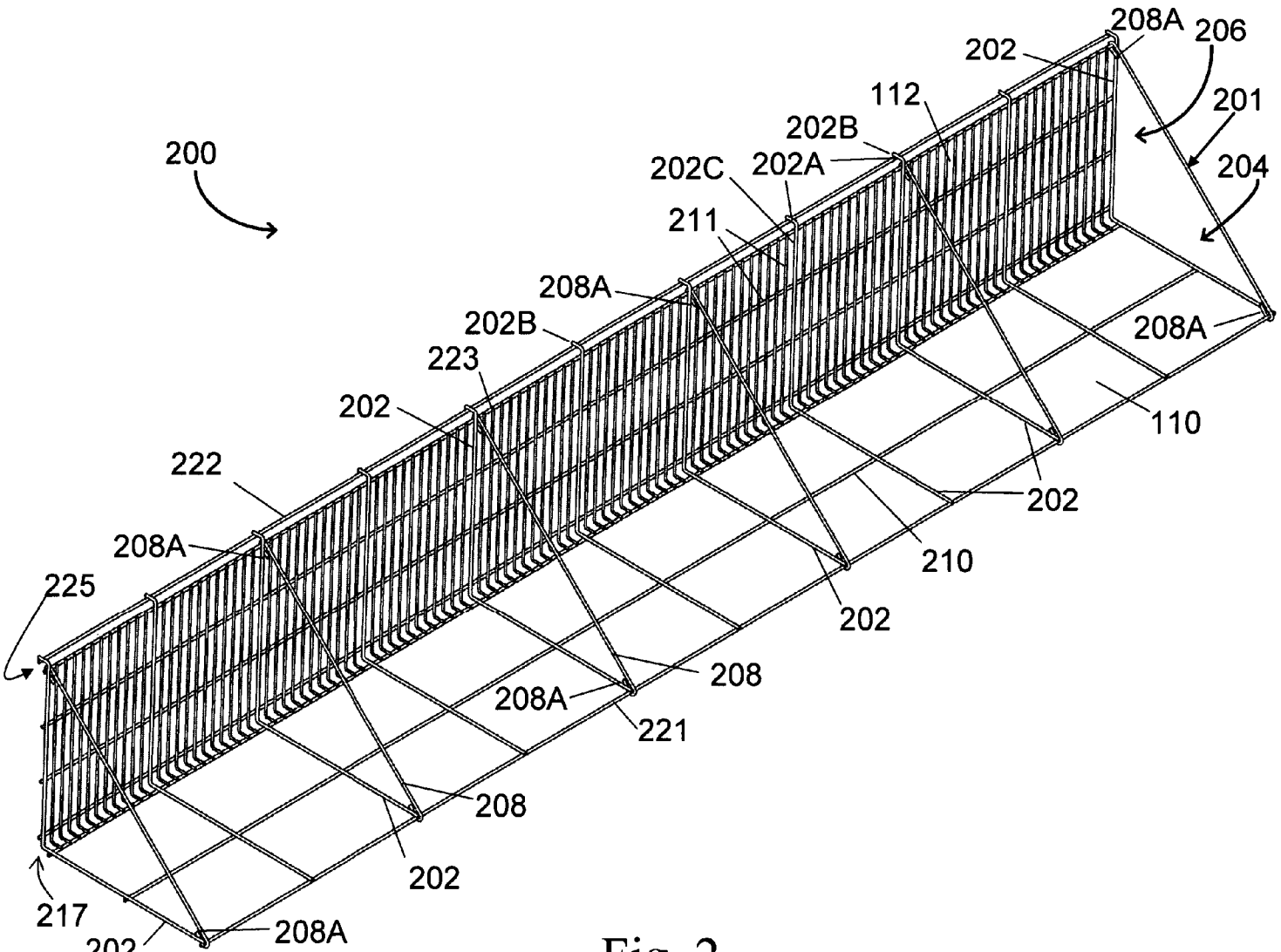
FIG. 2 is a perspective view of an earth-reinforcing revetment, according to some embodiments.

FIG. 2 is an illustration of another embodiment of an earth-reinforcing revetment, generally designated 200. As shown, the earth-reinforcing revetment 200 may include a single overall landscaping apparatus 201 formed of a first structure 204 having a base region and a second structure 206 having an elevated region. The revetment 200 may include a first plurality of openings 110 that pass through the first structure 204 and that have a substantially uniform measure of openings, and a second plurality of openings 112 through the second structure 206. In some embodiments, the single landscaping apparatus 201 of the earth-reinforcing revetment 200 may include a wire mesh, such as a steel mesh or a galvanized welded wire mesh. Other suitable materials could be steel welded wire, galvanized welded wire, welded galvanized wire, stainless steel wire, metal alloy wire, fibre glass reinforced grid, composite reinforced grid, or zinc or aluminum coated wire. Epoxy coated or powder coated wires may also be used.

The landscaping apparatus 201 of the earth-reinforcing revetment 200 may also include a plurality of secondary wires 210, 211. In some embodiments, the plurality of secondary wires 210 may further define openings 110 in the base region of the first structure 204 and the wires 211 may define openings 112 in the elevated region of the second structure 206. The openings form a mesh. Specifically, a physical mesh size of the base region of the first structure 204 may be greater than a mesh size of the elevated region of the second structure 206. In doing this, the amount of material used for the base region of the first structure 204 of the landscaping apparatus 201 of the earth-reinforcing revetment 200 is less than the amount of material used for a similarly sized elevated region of the second structure 206 thereof.

Furthermore, in some embodiments, the landscaping apparatus 201 of the earth-reinforcing revetment 200 may include a plurality of support struts 208 and lower and upper perimeter wires 221, 223 such that the support struts 208 may hook over the perimeter wires 221, 223. The support struts 208 may alternately or additionally be welded to the perimeter wires 221, 223. The bent structure of the landscaping apparatus 201 of the earth-reinforcing revetment 200 may have some springiness, such that when the struts 208 are hooked over the perimeter wires 221, 223 the first and second structures 204, 206 must be moved somewhat towards each other to allow the hooks 208A of the struts 208 to reach over. When released, the first and second structures 204, 206 spring out again to hold the struts 208 in position. Moreover, the support struts 208 may be galvanized wire support struts and may interlock with any suitably positioned wires in the landscaping apparatus 201. The second structure 206 contains additional wires 211 compared to the first structure 204. In such embodiments, the galvanized welded wire mesh may be capable of being bent, as shown at 217, to form an angle, such as an angle measuring approximately 90 degrees.

An optional feature shown in FIG. 2 is a lip 225 formed on an upper end portion of the elevated region, opposite from the bend 217, by upper end portions 202A of the wires 202 of the first structure 204 and by a substantially linear wire 222. The upper end portions 202A of selected ones of the wires 202 are bent relative to adjacent upright portions 202C of the wires 202 so as to protrude to outer ends 202B disposed outwardly from the elevated region, away from the base region, and past the upper perimeter wire 223 of the second structure 206 of the landscaping apparatus 201. The linear wire 222, spaced outwardly from the elevated region away from the base region, is affixed, and arranged to extend across and in underlying transverse relation to, outer ends 202B of the bent upper end portions 202A of the wires 202. The lip 225 may be useful for attaching primary reinforcement, for connecting additional wires 211 or for aligning multiple apparatuses 201 on top of each other.

Figure 2A:
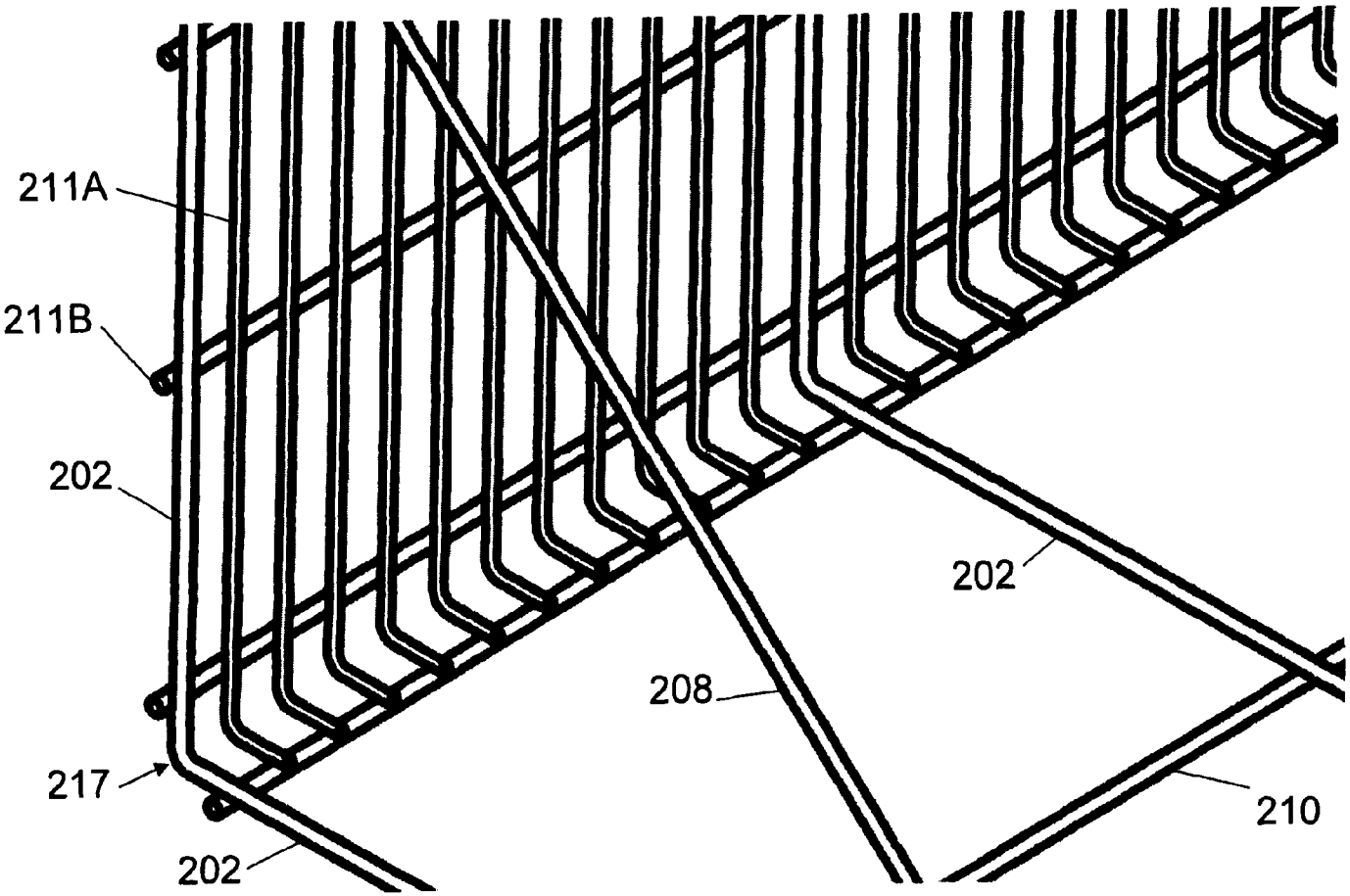
FIG. 2A is an enlarged view of a portion of the earth-reinforcing revetment of FIG. 2.

As shown in FIG. 2 and more particularly in FIG. 2A, the landscaping apparatus 201 of the earth-reinforcing revetment 200 may include a plurality of wires 211A, 211B and 202 that may all be of different thicknesses. In this embodiment, wire 202 is larger in diameter than wire 211B, which in turn is of larger diameter than wire 211A. In other embodiments, the wires may be the same thickness, or the additional wires 211A may be thicker than the other wires. Wires 211A are not necessarily needed for providing rigidity to the apparatus as a whole, as this is primarily provided by the remainder of the wires. However, the wires 211A provide extra rigidity to the elevated structure 206. Wires such as 211, 211A and 211B can be narrower, cheaper and easier to bend than the others, as their function is primarily to prevent passage of landscaping material through the second structure 206. The cost of materials for fabrication of the landscaping apparatus 201 of the earth-reinforcing revetment 200 may be substantially reduced, as discussed above and elsewhere herein.

The benefit of the addition wires 211A being bent as at 217 is that backfill is prevented from leaking out from underneath the elevated structure 206. This is particularly important when aligning multiple apparatuses 201 on top of each other to form a vertical or near vertical landscaping feature. The extension of the wires 211A around the bend 217 to terminate within the generally rectangular perimeter of the base region of the first structure 204 also provides some additional rigidity. The base region of the first structure 204 and the elevated region of the second structure 206 can be said to share the portions of their perimeters that lie in the bend 217.

In an alternative embodiment some or all of the additional wires 211A may terminate within the perimeter of the elevated region of the second structure 206. They may terminate in the elevated region of the second structure 206 close to the corner 217, without being bent around the corner.

In yet another alternate embodiment, the wires 211A may start within the perimeter of the elevated region of the second structure 206 pass round the corner 217 and terminate within the perimeter of the base region of the first structure 204.

In another embodiment, the wires 211A may be arranged diagonally with respect to other wires in the structure, starting at one perimeter in the elevated region of the second structure 206 and terminating at a perimeter in the base region of the first structure 204, such that the density of wires is significantly higher in the elevated region of the second structure 206 than the base region of the first structure 204.

In some embodiments, at least a portion of the plurality of wires may include one or more primary wires 202 extending from a base region of the first structure 204 of the landscaping apparatus 201 of the revetment 200 to an elevated region of the second structure 206 thereof. Specifically, the primary wires 202 may include a first portion and a second portion defined by a bend 217 in each wire, where the first portion may be arranged in the base region of the first structure 204 of the landscaping apparatus 201 and where the second portion may be arranged in the elevated region of the second structure 206 thereof. Furthermore, the support strut 208 may couple the first perimeter wire 221 and second perimeter wire 223 of the landscaping apparatus 201 so as to maintain an angle between the base region of the first structure 204 and the elevated region of the second structure 206. Also, the wires 210 and 221 are arranged to extend across the first portion of the primary wires 202 so as to form the base region with a first measure of openings. Further, the wires 211B are arranged to extend across the second portion of the primary wires 202, and the wires 211A are arranged to extend across the wires 211B and along and spaced from the primary wires 202, so as to form the elevated region with a second measure of openings reduced relative to the first measure of openings.

Figure 3:
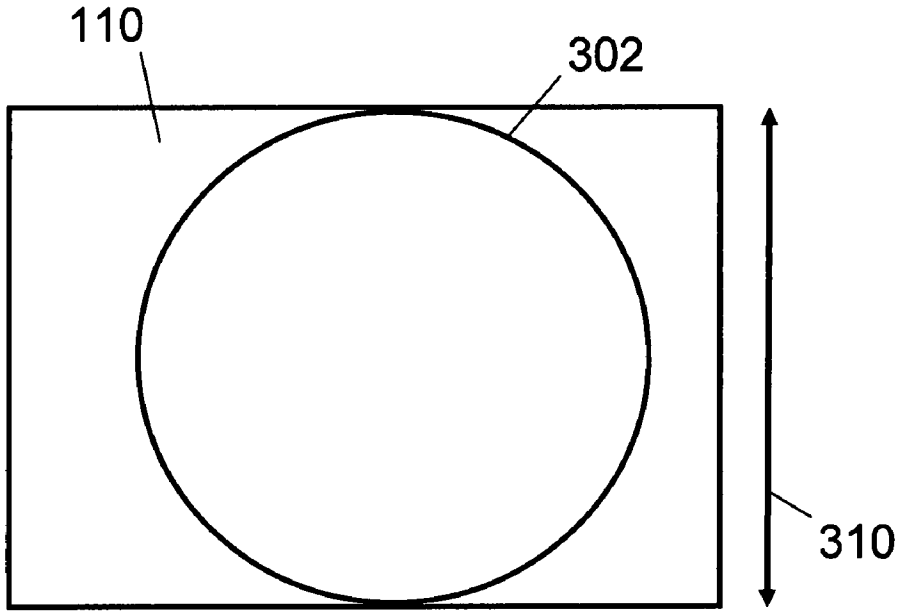
FIGS. 3 and 3A are diagrams showing measures of different openings in an earth-reinforcing revetment according to some embodiments.
Figure 3A:
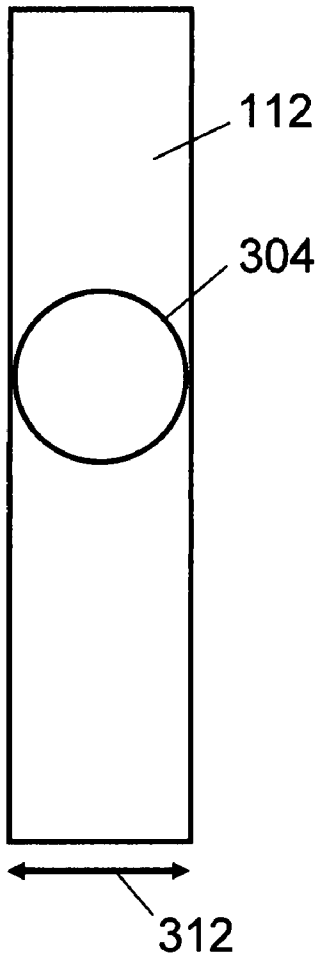

As previously mentioned, the plurality of wires in the landscaping apparatus 201 may define a mesh. Furthermore, the mesh may be selected so as to pass certain criteria for penetrability. Specifically, the mesh may be selected such that a flow of embankment, backfill or native material having certain dimensions may be reduced. In one example, the mesh may be capable of allowing a certain percentage of an embankment material to pass through the openings, or a certain size or particle. In particular, the penetrability of the mesh in the elevated region should be less than the penetrability of the mesh in the base region. Referring specifically to FIGS. 3 and 3A, exemplary theoretical particles of spherical embankment material 302, 304 may pass through corresponding openings 110, 112, but particle 302 will not pass through opening 112. Opening 110 in the first structure 106, 204, for example, may have a dimension 310 such that particles having a greatest diameter less than the dimension 310 of the opening are able to pass through the opening. Opening 112, in the second structure 108, 206 for example, may have a dimension 312 such that particles having a greatest diameter less than the dimension 312 of the opening are able to pass through the opening. The measure of an opening is best thought of as the diameter of the largest spherical particle that would pass through it. If the opening is rectangular, the measure is simply the width of the rectangle, irrespective of the relative sizes of the lengths of the rectangles. However, if the opening is irregularly shaped such a simple definition cannot be used.

It may be appreciated that the embankment material, backfill or native material, may include any suitable landscaping material. Examples of embankment material include without limitation earth, soil, peat, rocks, rubble, landfill, concrete and vegetation. Moreover, the embankment material may conform to certain geometric and/or size formats and/or acidity. For example, the embankment material may be first crushed and/or passed through a 2-inch sieve such that only embankment material whose largest diameter fits through the sieve may be used. Even further, the embankment material may have various properties. In one example, the embankment material may have a pH between 3 and 9. In doing this, the embankment material may be sized appropriately for use with the earth-retaining revetment and use of embankment materials that may have chemical incompatibilities with the earth-retaining revetment may be reduced.

Figure 4:
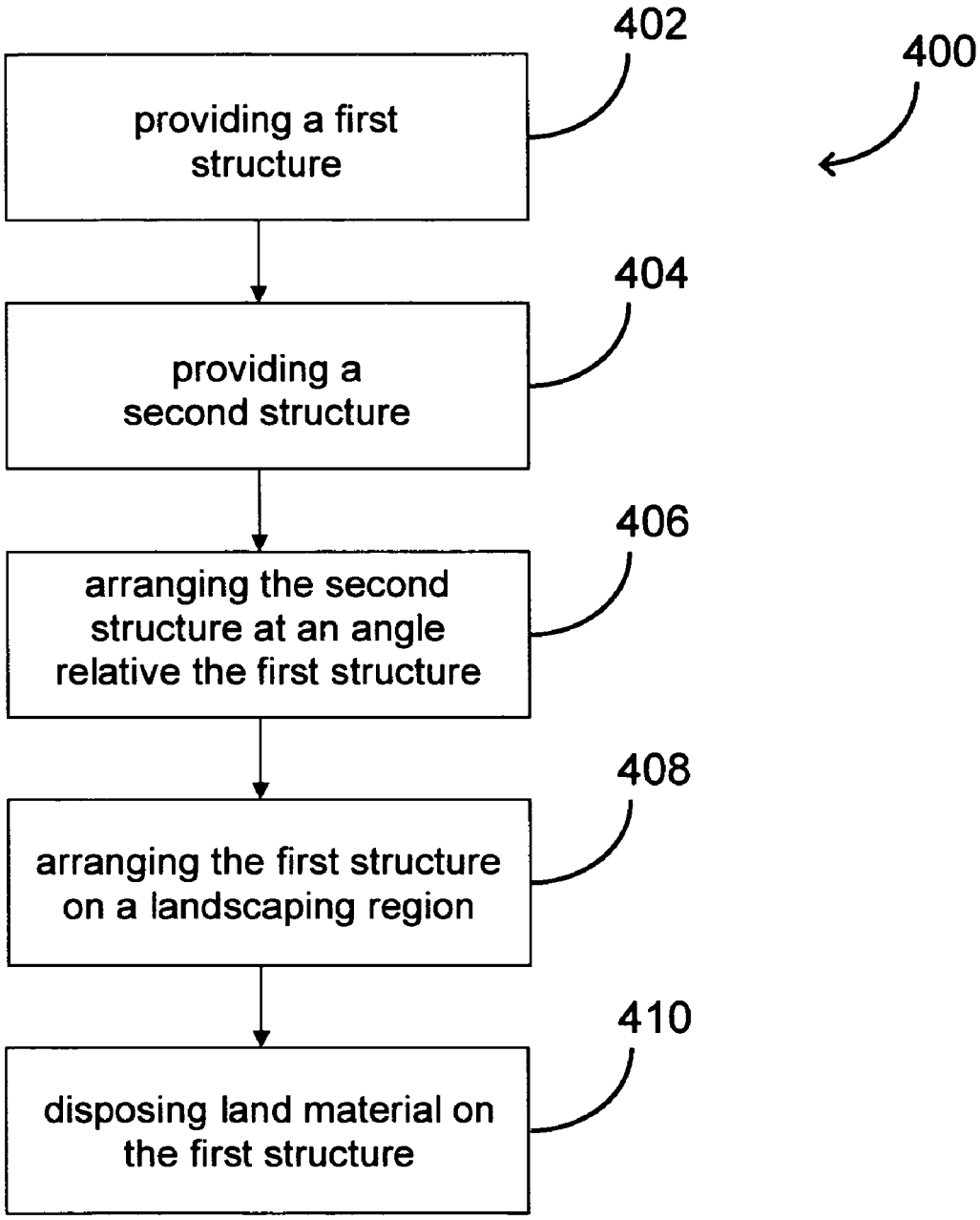
FIG. 4 is a flowchart of a method for landscaping, according to some embodiments.

FIG. 4 is a flowchart of an embodiment of a method for landscaping an area of land. In particular, flowchart 400 shows a method for defining a landscaping feature on a landscaping region of the area of land. For example, a hill or slope or vertical face may be defined on the area of land. Note that the area of land in its original state may be substantially flat or may already include landscaping features.

At step 402, the method of flowchart 400 includes providing a first structure of a landscaping apparatus, as described above. Next, at step 404, the method includes providing a second structure of the landscaping apparatus, also as described above. The first and second structures may be formed together as one planar structure by cutting the wires to the required length and arranging the wires in the desired positions in a horizontal plane, and then welding them together, either individually or several at a time.

The first structure and the second structure each include openings extending from a first surface, for example the top of the planar structure, to a second surface, for example the bottom of the planar structure. In particular, a measure of openings of the first structure is greater than a measure of openings of the second structure, as described above.

Continuing with the method of flowchart 400, at step 406, includes arranging the second structure at an angle relative to the first structure. Specifically, the first structure and the second structure may be arranged such that the planes of the first structure relative and the second structure define an angle. This can be done by bending the flat welded structure. In some embodiments, the angle may be approximately ninety degrees. Alternately, the angle may be an acute angle (i.e. less than ninety degrees). Furthermore, in some embodiments, the first structure and second structure may be coupled to form an angle of a unitary structure. Struts can then be added to make the structure more rigid, and maintain the angle between the first and second structures. This can be done after transporting the bent structure forming the landscaping apparatus to the site where it is intended to be installed, but this is not a requirement.

Next, at step 408, the method of flowchart 400 includes arranging at least a portion of the first structure on a landscaping region of the area. In particular, a base region of the first structure may be arranged such that the landscaping region supports the first structure of the landscaping apparatus.

Continuing, at step 410, the method includes disposing landscaping material on the first structure of the landscaping apparatus so as to define a feature for the area. In this way, a landscaping feature may be defined on the region of land. Further, additional landscaping material, such as grass, may be layered on the landscaping feature so as to define a hill or slope.

Figure 5:
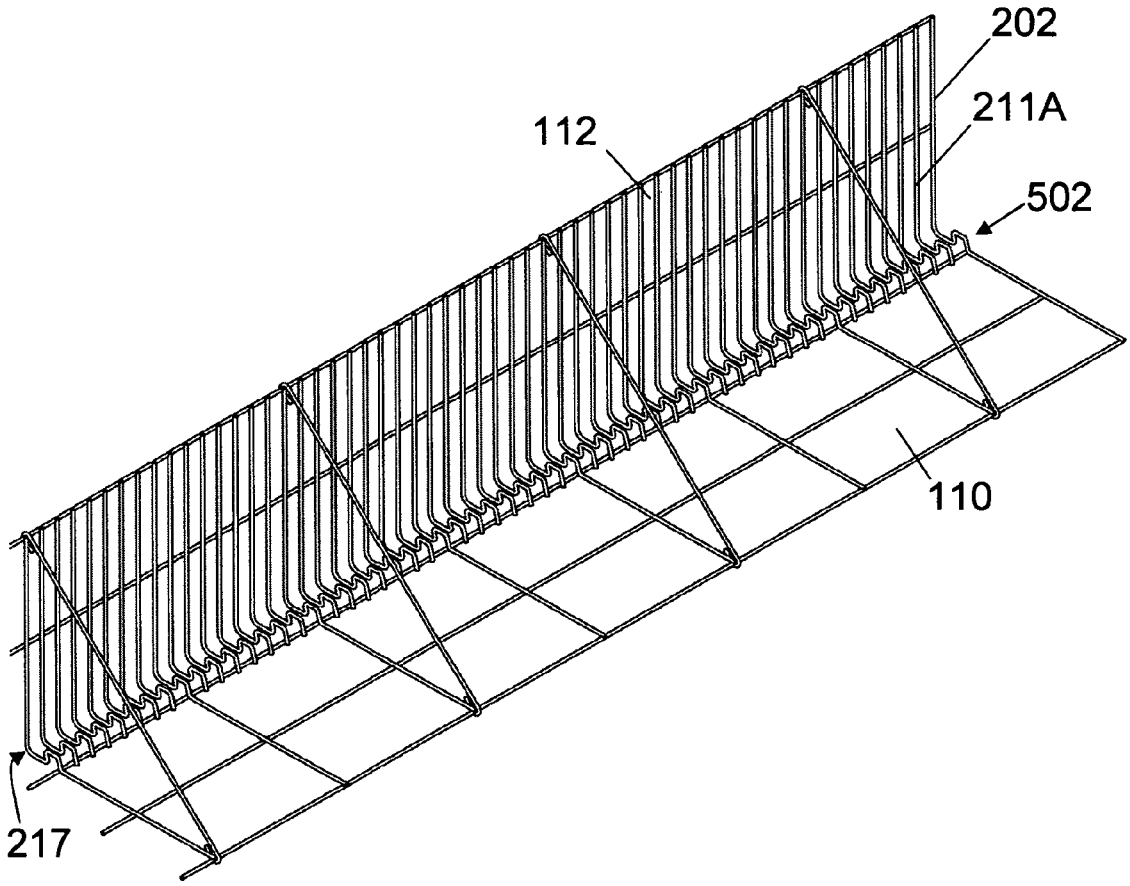
FIG. 5 is a perspective view of another earth-reinforcing revetment incorporating a recess, according to some embodiments.
Figure 6:
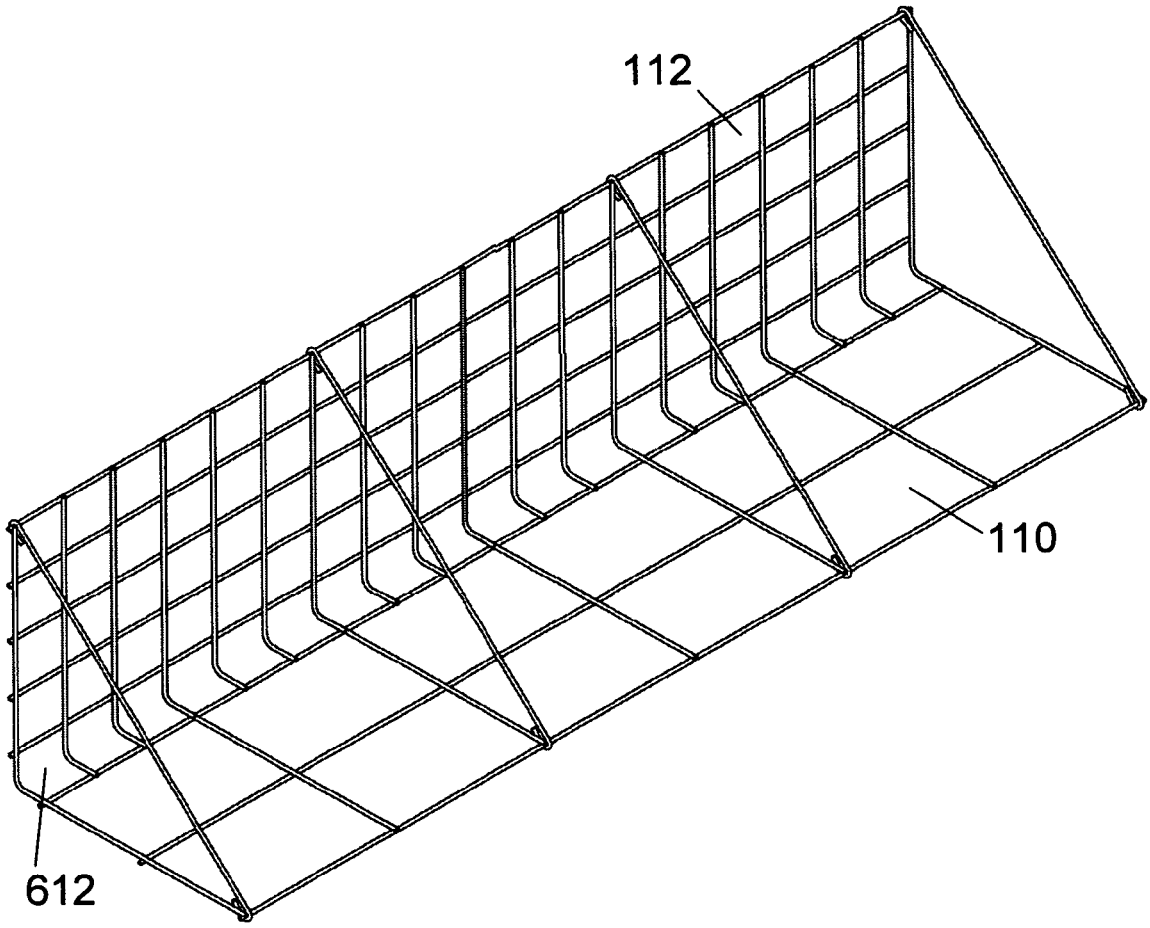
FIG. 6 is a perspective view of another earth-reinforcing revetment, according to some embodiments.
Figure 7:
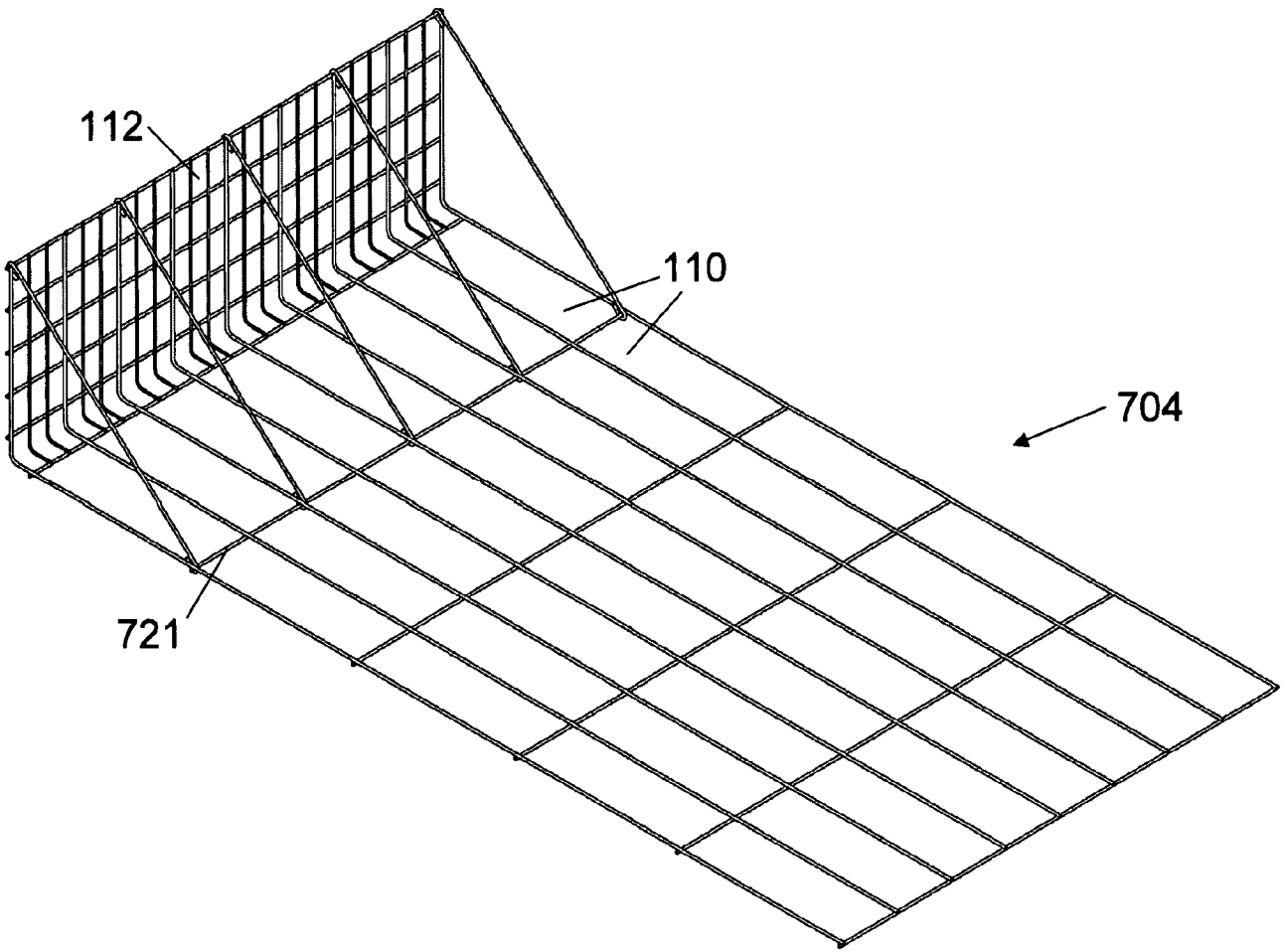
FIG. 7 is a perspective view of another earth-reinforcing revetment comprising an extended base region, according to some embodiments.

FIGS. 5-7 show additional embodiments of the landscaping apparatuses of earth-reinforcing revetments and illustrate exemplary configurations that may be understood as alternate embodiments, according to the present invention. FIG. 5 shows a recess 502 that can be used for accommodating an attachment to a layer of primary reinforcement. The recess 502 is formed with additional bends in the wires 211A and 202. Due to the termination of the wires 211A near the corner 217, and the need to economise on material costs, the location of the recess is in the proximity of the elevated structure 206. FIG. 6 shows how some of the openings 612 in the elevated region can be situated at the bend. FIG. 7 shows an extended first structure 704, for use in smaller landscaping projects, such as in residential areas or for low-rise landscaping features. The use of an extended base region can in some cases eliminate the necessity for primary reinforcement. In this example, the struts attach to a wire 721 within the first structure 704, rather than to a perimeter wire of the first structure.

Optionally, the landscaping apparatus of the earth reinforcing revetment could be manufactured from stamped metal sheet, or stamped, pressed and bent sheet. It could be made from plastic, by injection moulding or other heat treatment. Plastic fibres could be used.

The landscaping apparatus of the earth reinforcing revetment can have many different lengths, and the widths of the first and second structures may be similar or different.

Many other variations are also possible without departing from the scope of the claimed invention.

What is claimed is:

1. An earth-reinforcing revetment for landscaping an area, comprising:

a first plurality of wires, each of said wires having a first portion and a second portion defined by a bend of a given angle in said each wire;

a second plurality of wires, a first group of said wires of said second plurality arranged to extend across said first portions of said wires of said first plurality so as to form therewith a base region of a landscaping apparatus having a first measure of openings through said base region, a second group of said wires of said second plurality arranged to extend across said second portions of said wires of said first plurality so as to form therewith an elevated region of said landscaping apparatus having a second measure of openings through said elevated region, a respective one of said wires of said second plurality of each of the base and elevated regions being remotely spaced perimeter wires;

a support strut extending between and coupled to said remotely spaced perimeter wires of said second plurality in the base and elevated regions, wherein the support strut is adapted to maintain the angle of the bend in said each wire of said first plurality;

a third plurality of wires arranged to extend across said wires of said second group of said second plurality in said elevated region of said landscaping apparatus and spaced from said second portions of said wires of said first plurality in said elevated region of said landscaping apparatus so as to thereby reduce said second measure of openings in said elevated region relative to said first measure of openings in said base region;

a lip formed on an upper end portion of said elevated region opposite from said bend, said lip including upper end portions of selected ones of said wires of said first plurality in said elevated region being bent relative to adjacent portions of said wires in said elevated region so as to protrude to outer ends disposed outwardly from said upper end portion of said elevated region and away from said base region, and a wire spaced outwardly from said elevated region and affixed to, and arranged to extend across, said bent upper end portions of said wires of said first plurality; and wherein said wires of said first plurality form a recess in said base region proximate to said bend in each said wire of said first plurality and also proximate to said elevated region such that said recess is spaced remotely from said support strut and said perimeter wires of said second plurality in the base and elevated regions.

2. The revetment of claim 1, wherein said first and second measures of openings are determined based on the inverse of a number of openings per dimension along the respective region.

3. The revetment of claim 1, wherein said wires of said first plurality together with said wires of said third plurality extending into said base region form said recess proximate to said bend in each said wire of said first plurality.

4. The revetment of claim 1, wherein said wire of said lip is of substantially linear configuration.

5. An earth-reinforcing revetment for landscaping an area, comprising:

a first plurality of wires, each of said wires having a first portion and a second portion defined by a bend of a given angle in said each wire;

a second plurality of wires, a first group of said wires of said second plurality arranged to extend across said first portions of said wires of said first plurality so as to form therewith a base region of a landscaping apparatus having a first measure of openings through said base region, a second group of said wires of said second plurality arranged to extend across said second portions of said wires of said first plurality so as to form therewith an elevated region of said landscaping apparatus having a second measure of openings through said elevated region, a respective one of said wires of said second plurality of each of the base and elevated regions being remotely spaced perimeter wires;

a support strut extending between and coupled to said remotely spaced perimeter wires of said second plurality in the base and elevated regions, wherein the support strut is adapted to maintain the angle of the bend in said each wire of said first plurality;

a lip formed on an upper end portion of said elevated region opposite from said bend, said lip including upper end portions of selected ones of said wires of said first plurality in said elevated region being bent relative to adjacent portions of said wires of said first plurality in said elevated region so as to protrude to outer ends disposed outwardly from said upper end portion of said elevated region and away from said base region, and a wire spaced outwardly from said elevated region and affixed to, and arranged to extend across, said bent upper end portions of said wires of said first plurality; and wherein said wires of said first plurality form a recess in said base region proximate to said bend in each said wire of said first plurality and also proximate to said elevated region such that said recess is spaced remotely from said support strut and said perimeter wires of said second plurality in the base and elevated regions.

* * * * *